US005587541A

United States Patent [19]

McIntosh et al.

[11] Patent Number: 5,587,541

[45] Date of Patent: Dec. 24, 1996

[54] MUSICAL INSTRUMENT STRINGS

[75] Inventors: Bruce M. McIntosh, Harrogate; Francis S. Smith, Cheltenham; Noel A. Briscoe, Dursley, all of England

[73] Assignee: Zyex Limited, Gloucestershire, United Kingdom

[21] Appl. No.: 541,597

[22] Filed: Oct. 10, 1995

[30] Foreign Application Priority Data

Jul. 18, 1995 [GB] Great Britain ..... 9514688

[51] Int. Cl.[6] ..... G10D 3/00

[52] U.S. Cl. ..... 84/297 S; 84/199

[58] Field of Search ..... 84/199, 297 S

[56] References Cited

U.S. PATENT DOCUMENTS 4,586,708 5/1986 Smith et al. ..... 273/73 D 4,833,027 5/1989 Ueba et al. ..... 84/297 S X 5,427,008 6/1995 Ueba et al. ..... 84/297 S

FOREIGN PATENT DOCUMENTS 0148793 7/1985 European Pat. Off. .

*Primary Examiner*—Patrick J. Stanzione

*Attorney, Agent, or Firm*—Young & Thompson

[57] ABSTRACT

A string for a musical instrument comprises a thermoplastic aromatic polyetherketone and has a value of $E/\rho^2$ which is not greater than $5\times10^3$, where E is Young's modulus of the string material measured in $N/m^2$ and $\rho$ is the density of the string material measured in $kg/m^3$. Such a musical instrument string may have significantly lower internal damping than previously available strings, may show low inharmonicity, and may be unaffected by ambient humidity changes.

11 Claims, 7 Drawing Sheets

MUSICAL INSTRUMENT STRINGS

BACKGROUND OF THE INVENTION

Traditionally, strings for musical instruments have been made of natural gut derived from the intestines of animals, or metals such as steel, or synthetic materials particularly polyamide 6 or polyamide 6.6 and their copolymers, known generally as nylon. Strings may be simply single monofilaments of these materials, or they may consist of a core around which is wrapped metal wire or other material to increase the mass of the string without substantially increasing its lateral stiffness.

Natural gut is fragile and is greatly affected by changes in the ambient humidity, which can lead to the need for frequent retuning by the player. As a natural product, it is inconsistent in properties and deteriorates rapidly under adverse conditions of temperature and humidity. Nevertheless, some musicians believe it produces a superior sound, which favours its use on bowed instruments, although because of its deficiencies its use on classical guitars has been completely superseded by nylon.

Nylon has gained wide acceptance as a substitute for natural gut in music strings: it has the advantage of being a consistent manufactured product and is considerably more durable than natural gut. However, it still has certain deficiencies, notably a sensitivity to changes in humidity and significant loss of tension with time, so that retuning is often necessary. It also has a higher degree of internal damping than is desirable. In particular, a low degree of internal damping is required for a string used on a guitar or other plucked instrument, otherwise the vibrations of the string decay too quickly and the sound is dull and lifeless.

Some attempts have been made to reduce the internal damping of nylon music strings by various treatments. For example, U.S. Pat. No. 3,842,705 describes the use of irradiation by high intensity ionising radiation to improve the playing quality of nylon strings, and U.S. Pat. No. 4,015,133 similarly describes the use of radiation to improve the elasticity and reduce the damping in polyamide strings. However, these treatments require the use of radioactive sources or high intensity electron beams, and are expensive and technically difficult to carry out.

Steel strings do not suffer from the effects of humidity but their use is not generally acceptable on the classical guitar since they are necessarily much thinner than nylon or gut strings, which leads to difficulties in plucking with the fingers and reduces the control which the player has over the tone quality of the sound.

Other materials have been suggested for use in music strings. For example, U.S. Pat. No. 4,833,027 describes the use of polyvinylidene fluoride for music strings. European Patent 49368 discloses a string made of polyvinylidene fluoride and acrylate copolymer. Japanese Patent 61114297 describes music strings made of drawn polyacetal. However, none of these materials has shown in practice any substantial advantage over nylon strings in terms of stability or internal damping. Nylon string products dominate the guitar string market both as monofils and as wrapped multifils.

The objective of the present invention is an improved music string which may have significantly lower internal damping than presently available strings, may show low inhamonicity, and may be unaffected by ambient humidity changes. The invention may be understood in temps of the following theory, but is not dependent on the correctness of the theory and is not intended to be limited by it.

It is well known (see for example "The Theory of Sound" Volume I Section 189 by Lord Rayleigh published by McMillan & Co. 1984) that a vibrating string produces not only a fundamental frequency but also a series of hamonics of higher frequency than the fundamental. The frequency $f_n$ of the nth harmonic is given by:

$$f_n = \frac{n}{2l}\sqrt{\frac{T}{m}}\left[1+\frac{n^2\pi^3 r^4 E}{8l^2 T}\right] \quad \text{(i)}$$

where:

l=length of vibrating string
T=tension in the string
m=mass per unit length of the string
r=radius of the cross-section of the string
E=Young's modulus of the string material As n gets larger, the harmonics of the string deviate more and more from a simple whole number ratio with each other, leading to dissonance and an unsatisfactory quality of sound.

In order to minimise this effect, the second term in the bracket in the above expression must be as small as possible. That is to say:

$$I = \frac{\pi^3 r^4 E}{8l^2 T} \quad \text{(ii)}$$

must be small. I is referred to as the Inharmonicity Factor of the string. I may be rewritten as:

$$I = \frac{\pi}{128}\left[\frac{T}{l^6 f_1^4}\right]\left[\frac{E}{\rho^2}\right] \quad \text{(iii)}$$

where ρ=density of the string material and the other symbols have the same meaning as before. Thus to minimise I, the value of $E/\rho^2$ for the string material must be small.

It is found (see for example J. C. Schelling: *Journal of the Acoustical Society of America Volume* 53 (1973) Pages 26–41) that generally the value of I should not exceed about $6\times10^{-5}$ for satisfactory string performance, and preferably should be much less.

Some values of $E/\rho^2$ for known materials are given in Table I, together with the corresponding value of I when the material is used as a monofilament for the 3rd or G string of a classical guitar. Although monofilaments of nylon and steel give acceptable levels of inharmonicity for use as the highest three strings of a guitar, it can be seen that polyethylene terephthalate and aluminium, for example, are unacceptable.

TABLE I

Inharmonicity factor I for guitar 3rd strings made from different materials

| Material | $E/\rho^2 \times 10^{-3}$ | $I \times 10^5$ |
|---|---|---|
| Natural gut | 0.6–2.08 | 0.76–2.64 |
| Nylon | 2.56 | 3.25 |
| Steel | 3.45 | 4.37 |
| Polyester (PET) | 7.19 | 9.12 |
| Aluminium | 9.67 | 12.26 |

In order for a string material to be acceptable for use as the highest three strings of a guitar, the value of $E/\rho^2$ should not exceed about $5\times10^3$ and preferably should be less than $3\times10^3$. However, it must be understood that although a low value of $E/\rho^2$ is a necessary condition for low inharmonicity in a string, it is not in itself sufficient, since inharmonicity depends on other parameters including the length and tension of the string.

The motion of a vibrating string is damped by both viscous interaction with the surrounding air and by visco-elastic mechanisms within the string material itself. Both damping mechanisms lead to an exponential decay in the amplitude of vibration of a plucked string from the moment it is first set in motion. The amplitude of the vibration at time t is given by:

$$A_t = A_o e^{-t/\tau} \quad \text{(iv)}$$

In this expression, $A_o$ is the initial amplitude of the string vibration, e is the base of the natural logarithms, and $\tau$ is the characteristic decay time, i.e. the time required for the amplitude of vibration to decay to 1/e of its initial value.

The decay time $\tau$ observed for a given string is a combination of the decay time for air damping ($\tau_\alpha$) and internal damping ($\tau_\alpha$). Since both mechanisms act simultaneously, the total decay time $\tau$ is given by:

$$\frac{1}{\tau} = \frac{1}{\tau_a} + \frac{1}{\tau_i} \quad \text{(v)}$$

The air damping of a string is dependent only on the mass and diameter of the string, and not on the elastic properties of the string material itself Thus:

$$\tau_\alpha \propto \rho d \int^{-1/2} \quad \text{(vi)}$$

where d is the string diameter.

On the other hand, the internal damping is due to the inherent properties of the string material. All real materials, especially polymeric materials such as natural gut and nylon, show a time dependence of strain on applied stress. This so-called visco-elastic behaviour means that when a stress is applied the final value of strain is not achieved instantaneously, but requires time to reach its equilibrium value. This type of behaviour can be represented by expressing the Young's modulus of the material as a complex number, i.e.

$$E = E_1 + iE_2 \quad \text{(vii)}$$

where $E_1$ is the modulus contributed by normal elastic bond distortion, and $E_2$ is the contribution from bond rotation and movement of kinks in the polymer chains. The decay time due to this mechanism can be shown to be represented by:

$$\tau_i \propto \frac{1}{f} - \frac{E_1}{E_2} \quad \text{(viii)}$$

A more extended account of the damping of music strings has been given by N. H. Fletcher in "Paper given to the Catgut Acoustical Society Technical Conference, Montclair, N.J., April 1975" published by that Society.

The visco-elastic behaviour of natural and synthetic polymers such as natural gut and nylon is well known, so it is not surprising that the damping of strings made from these materials is high. Metals show lower visco-elasticity and correspondingly lower damping when used in music strings.

Since the decay time for internal damping is proportional to the inverse of frequency, the decay of the higher harmonics of the string relative to the fundamental will be greater than would be the case if only air damping applied since air damping is proportional only to the inverse square root of frequency. Hence a reduction in internal damping will lead to more sustained higher harmonics, and therefore a brighter and more lively sound. In particular, the enhancement of the second harmonic is well known to produce a more brilliant tone.

We have now found that, surprisingly in view of their polymeric nature, aromatic polyetherketones can be processed into strings in such a way that the internal damping is reduced to a very low level. In addition, these strings may have a value of $E/\rho^2$ which is less than $5\times10^3$ and generally less than $3\times10^3$.

Polyetherketones have the general formula.

—Ar—O— where Ar is an aromatic radical and at least some of the Ar radicals contain a ketone linkage. A preferred thermoplastic aromatic polyetherketone is polyetheretherketone, having the repeat unit:

—O—Ph—O—Ph—CO—Ph— where Ph is a p-phenylene. This polymer can be readily melt spun and drawn into filaments which we have found to show remarkable durability and stability under tension, and are virtually unaffected by ambient humidity.

The superior damping properties of strings of the present invention may be characterised by measuring the decay time of the fifth harmonic of the string when it is set into vibration by plucking, and comparing this with the decay time of the fundamental vibration of the string. The ratio of the decay time of the fifth harmonic to the decay time of the fundamental is called the Damping Ratio.

SUMMARY OF THE INVENTION

According to the invention there is provided a string for a musical instrument, said string comprising a thermoplastic aromatic polyetherketone and having a value of $E/\rho^2$ which is not greater than $5\times10^3$, where E is Young's modulus of the string material measured in $N/m^2$ and $\rho$ is the density of the string material measured in $kg/m^3$.

Preferably the string has a value of $E/\rho^2$ which is not greater than $3\times10^3$.

The Damping Ratio of the string, defined as the ratio of the decay time of the fifth harmonic to the decay time of the fundamental, is preferably not less than 0.50, and more preferably not less than 0.55.

It is also preferred that the ratio of the amplitude of the second harmonic of the string to the amplitude of the fundamental is not less than 1.00, and that the Inharmonicity Factor of the string is less than $3\times10^{-5}$.

In any of the strings according to the invention the thermoplastic aromatic polyetherketone may be polyetheretherketone.

One embodiment of a string for a musical instrument may comprise a core made up of one or more strings of any of the kinds according to the invention, the core being covered by a closely wound helical winding of a further material, such as metal wire.

BRIEF DESCRIPTION OF THE DRAWINGS

The invention may be illustrated by the following examples which exemplify, but should not be taken to limit, the invention. Reference is made to the accompanying figures in which.

DETAILED DESCRIPTION OF THE DRAWINGS

Test Methods (a) Young's Modulus

Figure 1:
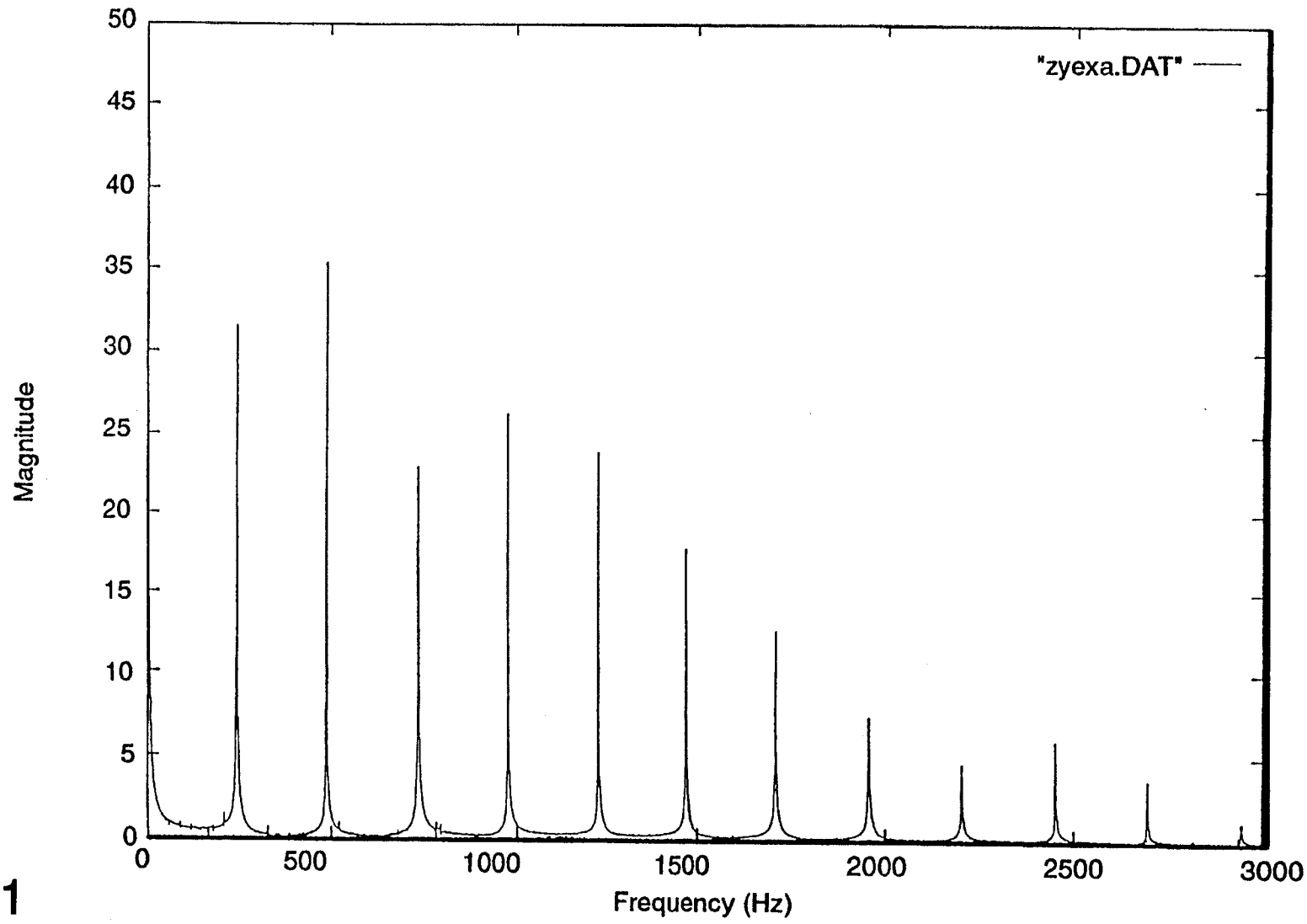
FIG. 1 is a Fourier transform plot of amplitude against frequency for a first example of a music string according to the invention, showing the amplitudes of the fundamental and harmonics of the string.

The Young's modulus of the strings was measured by determining the slope of the tangent to the stress-strain curve at the origin, when a sample of test length 200 mm was extended at 50 mm/min in a tensile testing machine.

(b) Damping ratio

The string to be tested was mounted on an acoustic bench and supported by two bridges 645 mm apart. It was set in vibration by plucking at 50 mm from one end. Plucking was accomplished by looping a fine copper wire round the string, then pulling the wire until it broke and released the string into free vibration. The breaking load of the wire loop was 230 g. The string was tensioned so that the frequency of its fundamental vibration was 247 Hz. A piezo-electric transducer mounted on one bridge detected the vibrations of the string, and the signal from this transducer was passed through a narrow pass filter (30 Hz bandwidth) which was centred on a frequency of 247 Hz to measure the decay time of the fundamental, or a frequency of 1240 Hz to measure the decay of the fifth hamionic The output of the filter circuit was a DC signal proportional to the amplitude of the input AC signal. The DC signal, giving amplitude as a function of time, was used to determine the time taken for the amplitude of vibration to fall to 1/e of its initial value. This value is the decay time for the frequency being measured.

The Damping Ratio is defined as the ratio of the decay time of the fifth harmonic to the decay time of the fundamental.

(c) Inharmonicity

The electrical output from the piezo-electric transducer was applied to an analogue/digital converter and the digitised signal processed by computer to give a Fourier transform. The exact frequencies of the first ten harmonics were obtained from the Fourier transform, and the Inharmonicity factor determined by comparing the measured frequencies of the fundamental and the tenth harmonic. From equations (i) and (ii) it follows that:

$$I = \left[ \frac{f_{10}}{10 f_1} - 1 \right] \times 10^{-2} \qquad \text{(ix)}$$

where $\int_1$ and $\int_{10}$ are the frequencies of the fundamental and tenth harmonic respectively.

(d) Ratio of Amplitudes

The ratios of the amplitude of the 2nd to the fundamental harmonic are listed in Table II. The ratio of the amplitude of the second harmonic to that of the fundamental was determined from the Fourier transform plots given in FIGS. 1 to 7.

EXAMPLE 1

A polyetheretherketone of intrinsic viscosity 0.98 measured at 25° C. in a solution of 0.1 gram of the polymer in 100 ml of 98% sulphuric acid was melted in an extruder at 375° C. and spun at 37 grams per minute from a 2.0 mm spinneret hole at a feedroll speed of 22.5 meters per minute (mpm). The monofilament was cooled and hot roll drawn at 180° C. with a draw ratio of 2.96, relaxed at 395° C. by 15.8% before being wound up at 56 mpm as a 0.85 mm filament. The filament was then centrelessly ground in lengths to produce strings suitable for fitting to most musical instruments.

By this process a filament of diameter 0.74 mm and linear density 0.56 g/m was obtained. This size and weight of string is commonly used as the 2nd (B) string of a classical guitar.

The Young's modulus of the string was found to be $3.7\times10^9$ N/m$^2$ and the material density was 1300 kg/m$^3$ giving a value for $E/\rho^2$ of $2.2\times10^3$.

The Damping Ratio, the ratio of amplitudes and the inharmonicity factor of the string were measured using the test procedures given above. The results are given in Table II. Also given in this table are test results obtained on commercially available guitar 2nd strings in various materials. It can be seen that the Damping Ratio for the string of Example 1 is much greater than that of any of the prior art strings, and that the measured inharmonicity is acceptably low. The amplitudes of the harmonics of the string vibration derived from the Fourier transform are shown in FIG. 1. The increased amplitudes of the higher harmonics relative to the fundamental is evident, especially in comparison with strings of prior art materials shown in FIGS. 4 to 7.

In particular, it is well known that the increased amplitude of the 2nd harmonic relative to the fundamental gives a more brilliant sound.

EXAMPLE 2

A monofilament of polyetheretherketone was produced as in Example 1 except that the throughput was 39 grams per minute, feedroll speed 34 mpm, a draw ratio of 2.65, relax of 14.4% and wind up speed of 77 mpm. The filament was not centrelessly ground.

Figure 2:
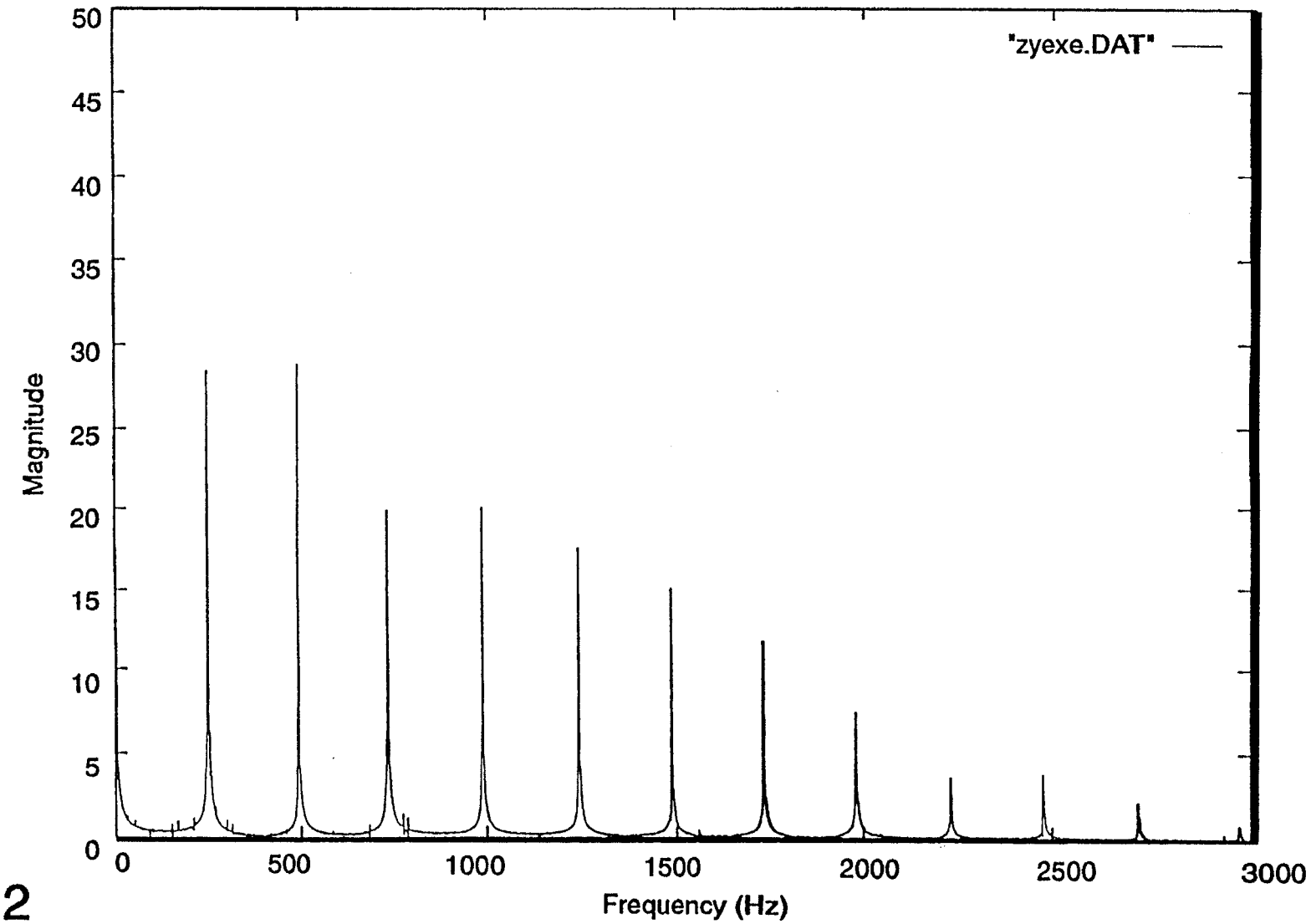
FIG. 2 is a similar plot for a second example of a string according to the invention.
Figure 3:
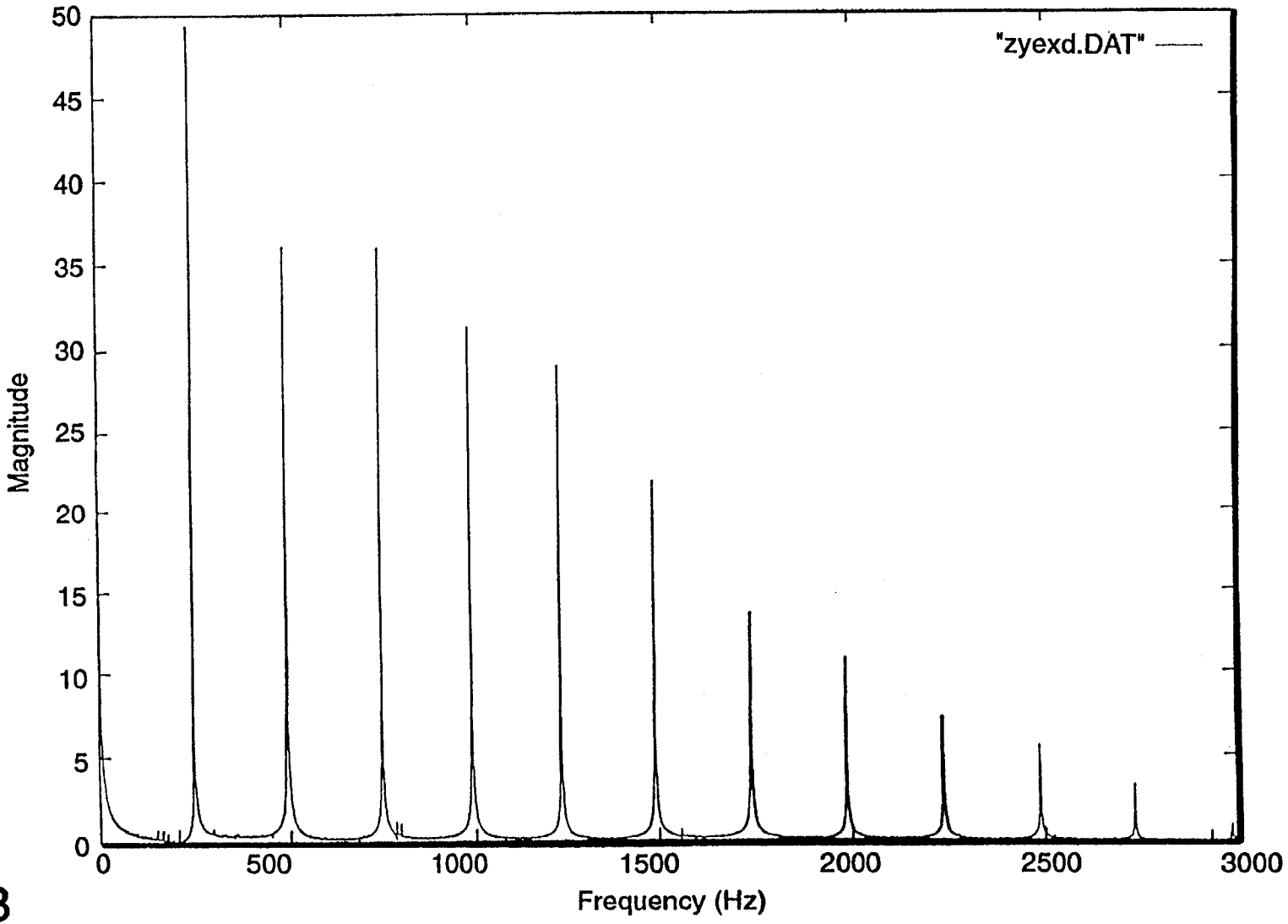
FIG. 3 is a similar plot for a third example of a string according to the invention.
Figure 4:
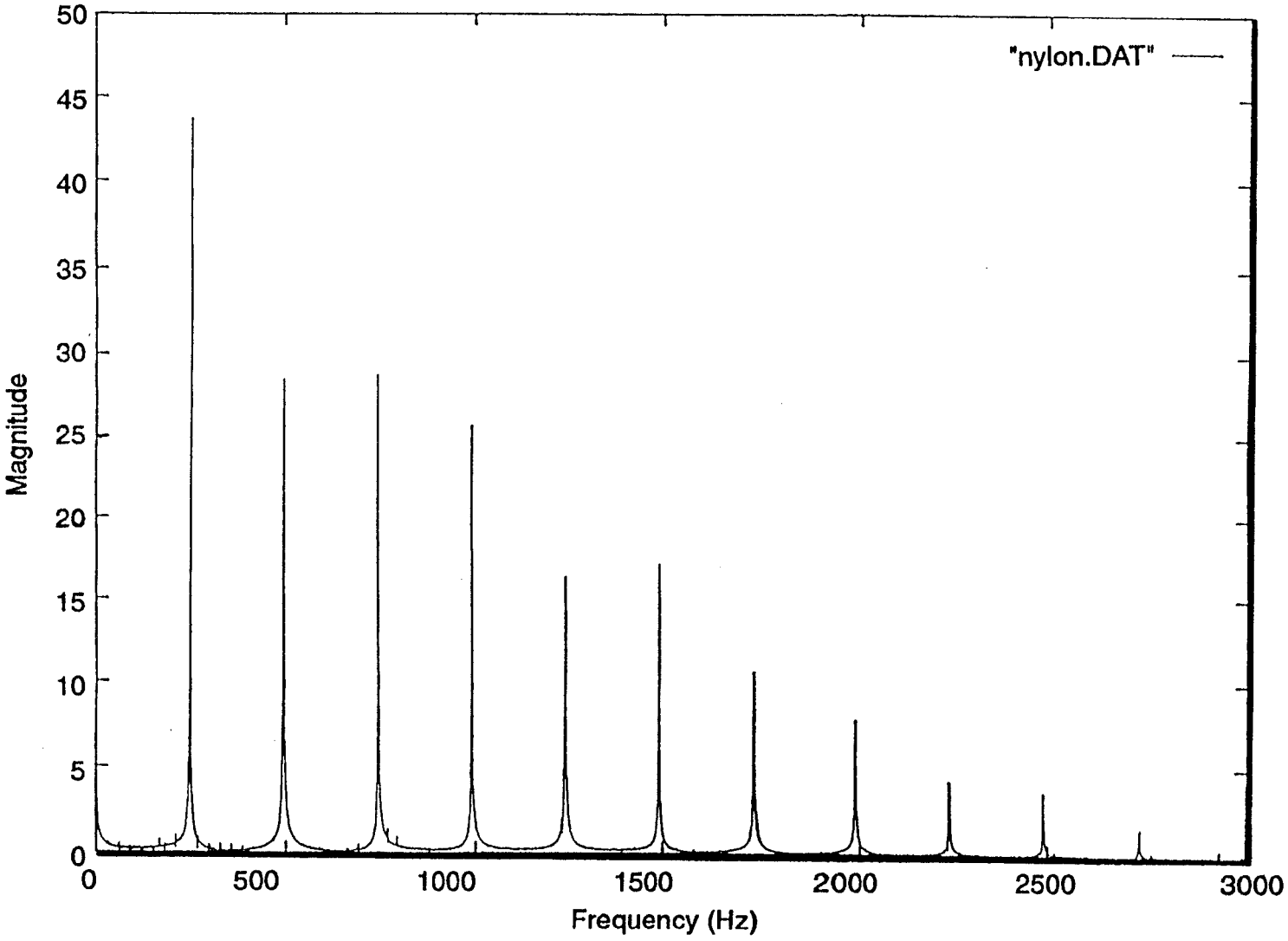
FIG. 4 PRIOR ART
FIG. 4 is a similar plot for a prior art nylon music string.
Figure 5:
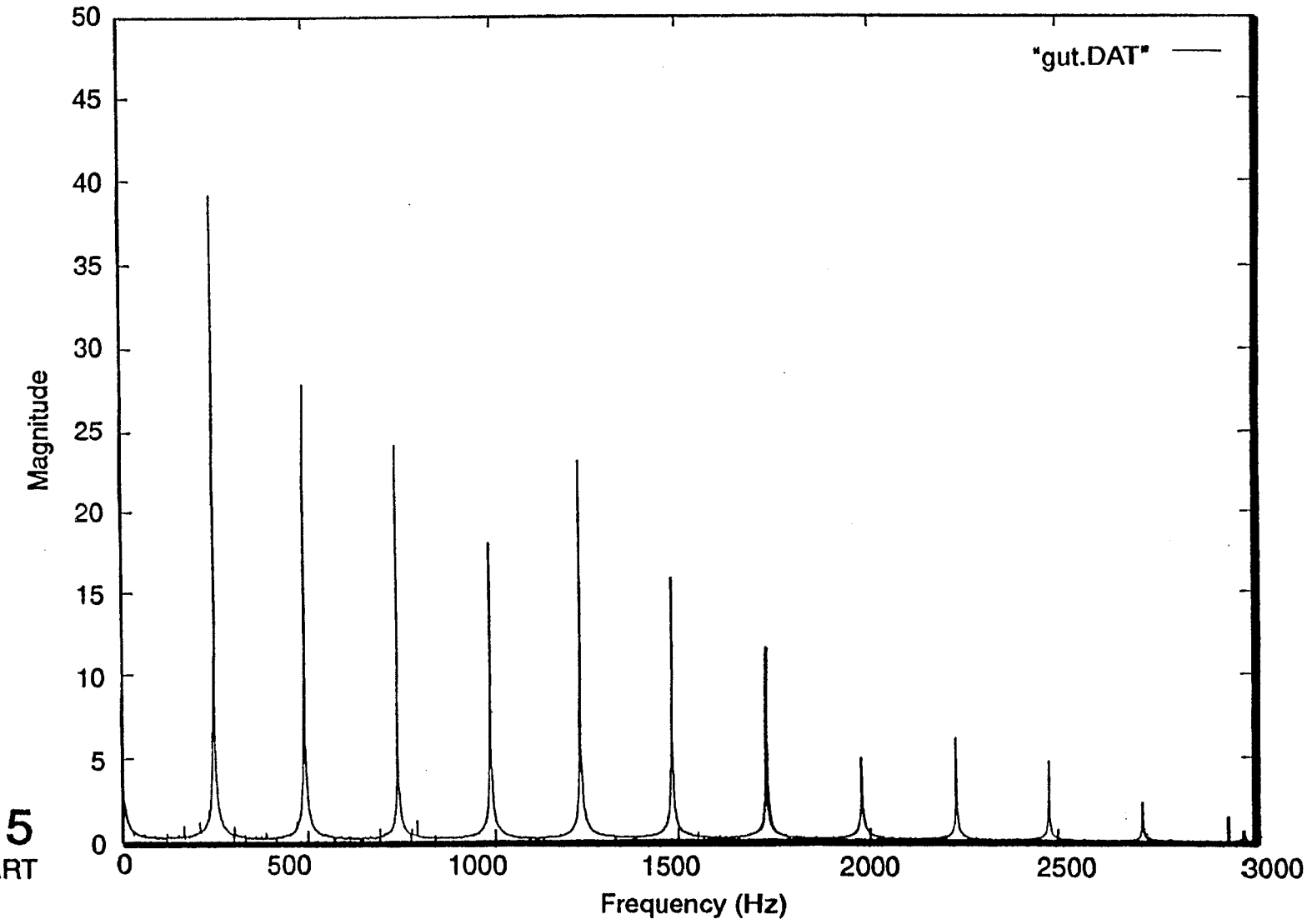
FIG. 5 PRIOR ART
FIG. 5 is a similar plot for a prior art natural gut string.
Figure 6:
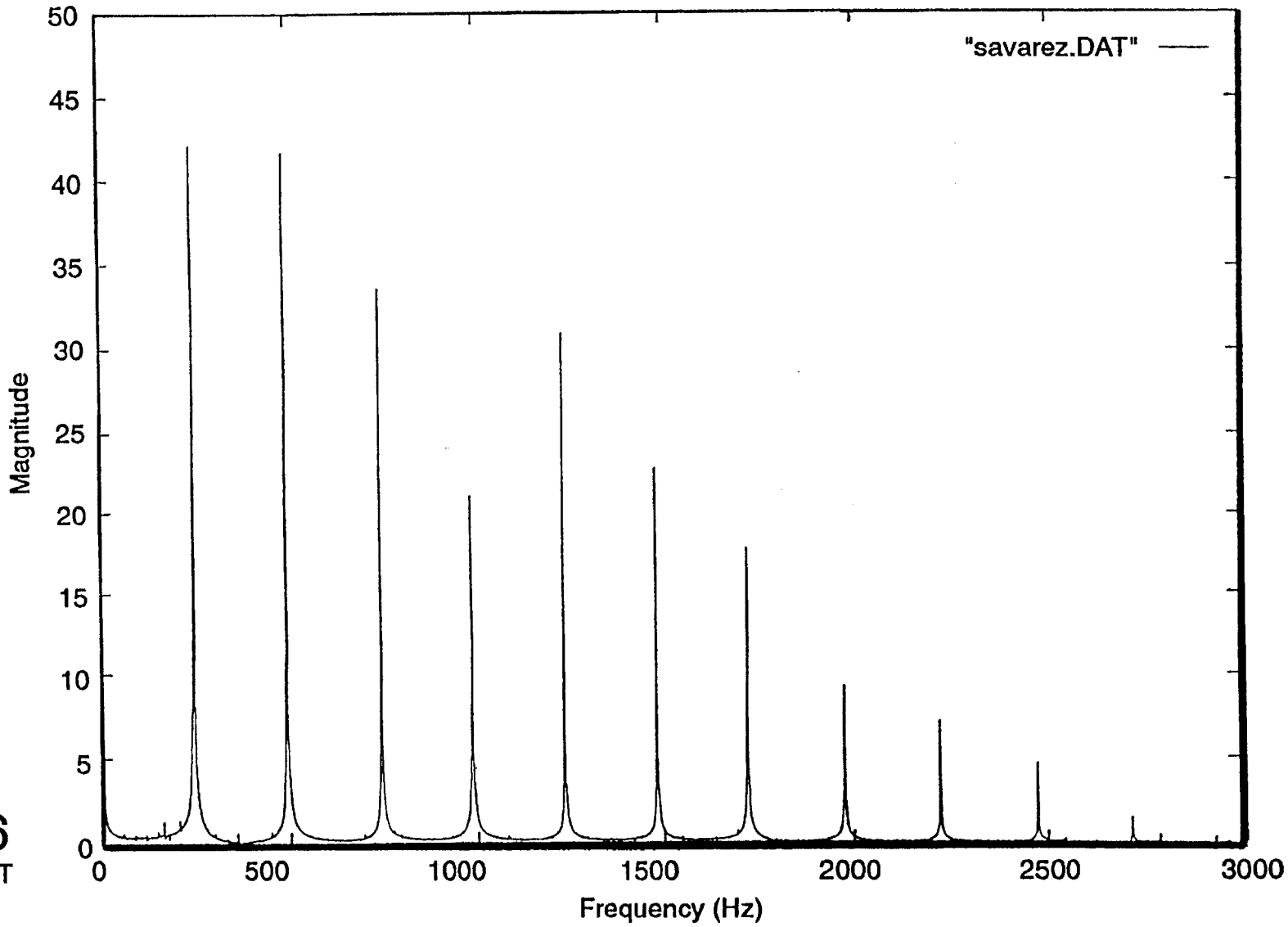
FIG. 6 PRIOR ART
FIG. 6 is a similar plot for a prior art polyvinylidene fluoride string.
Figure 7:
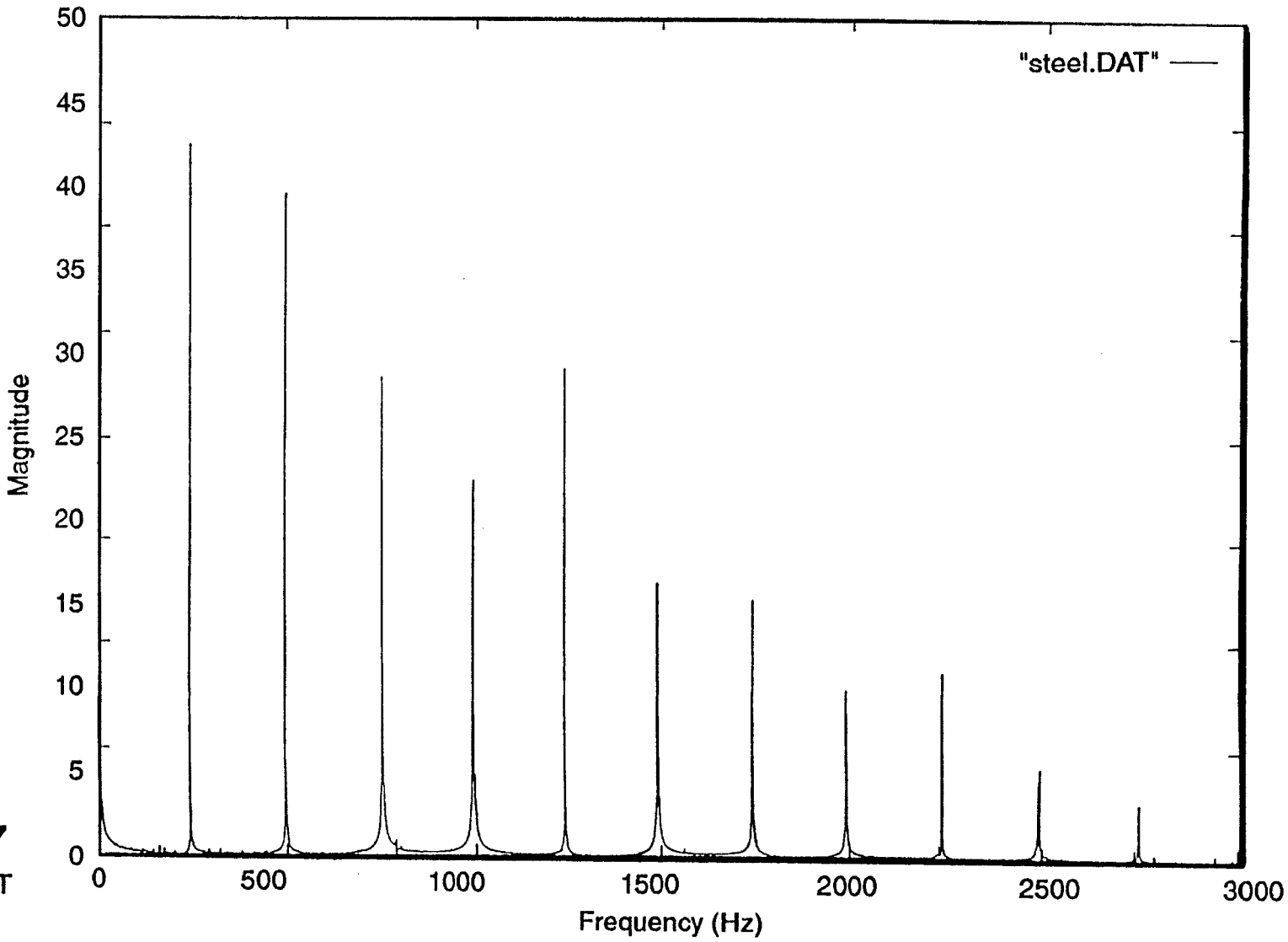
FIG. 7 PRIOR ART
FIG. 7 is a similar plot for a prior art steel string.

The filament diameter was 0.7 mm and the linear density was 0.50 g/m. This was tested using the aforementioned test procedures and the results are given in Table II. The measured inharmonicity is slightly lower than that of the string of Example 1 as would be expected from the lower diameter. The Damping Ratio, however, remains well above that of prior art strings. The acoustic spectrum in FIG. 2 is similar to that of Example 1, with the amplitude of the 2nd harmonic again higher than the fundamental.

EXAMPLE 3

A monofilament string was produced as in Example 1 except that the throughput was 36.5 grams per minute, feedroll speed 22.5 mpm, a draw ratio of 2.96, relax of 15.8 and temperature of 365° C., and wind up speed 56 mpm. The filament was not centrelessly ground.

The acoustic spectrum (FIG. 3) showed that the amplitudes of the harmonics relative to that of the fundamental were lower than for Examples 1 and 2 and the 2nd harmonic fell below the amplitude of the fundamental.

TABLE II

| String | FIG. Ref. | Diameter mm | Linear Density g/m | Measured Inharmonicity Factor × $10^5$ | Decay time (s) Fund. | Decay time (s) 5th harm | Damping Ratio | Ratio of Amplitudes (2nd harmonic to fundamental) |
|---|---|---|---|---|---|---|---|---|
| Example 1 | a | 0.74 | 0.56 | 2.7 | 0.805 | 0.458 | 0.57 | 1.12 |
| Example 2 | b | 0.70 | 0.50 | 2.6 | 0.592 | 0.335 | 0.56 | 1.04 |
| Example 3 | c | 0.80 | 0.65 | 6.1 | 0.977 | 0.479 | 0.49 | 0.73 |
| Prior art strings | | | | | | | | |
| Nylon (Augustine) | d | 0.82 | 0.55 | 1.6 | 0.830 | 0.392 | 0.47 | 0.65 |
| Natural gut (Salvi) | e | 0.76 | 0.59 | 4.0 | 0.887 | 0.400 | 0.45 | 0.71 |
| Pvdf (Alliance Savarez KF) | f | 0.71 | 0.71 | 7.7 | 1.219 | 0.502 | 0.41 | 0.97 |
| Steel | g | 0.42 | 1.08 | 4.9 | 3.118 | 1.332 | 0.43 | 0.88 |

We claim:

1. A string for a musical instrument, said string comprising a thermoplastic aromatic polyetherketone and having a value of $E/\rho^2$ which is not greater than $5\times10^3$, where E is Young's modulus of the string material measured in $N/m^2$ and ρ is the density of the string material measured in $kg/m^3$.

2. A string according to claim 1, wherein the string has a value of $E/\rho^2$ which is not greater than $3\times10^3$.

3. A string according to claim 1, wherein the Damping Ratio of the string, defined as the ratio of the decay time of the fifth harmonic to the decay time of the fundamental, is not less than 0.50.

4. A string according to claim 3, wherein the Damping Ratio is not less than 0.55.

5. A string according to claim 1, wherein the ratio of the amplitude of the second harmonic of the string to the amplitude of the fundamental is not less than 1.00.

6. A string according to claim 1, wherein tile Inharmonicity Factor of the string is less than $3\times10^{-5}$.

7. A string according to claim 1, wherein the diameter of the string is in the range of about 0.70 to 0.75 mm.

8. A string according to claim 1, wherein the linear density of the string is in the range of about 0.5 to 0.65 g/m.

9. A string according to claim 1, wherein the thermoplastic aromatic polyetherketone is polyetheretherketone.

10. A string for a musical instrument comprising a core made up of one or more strings according to claim 1, the core being covered by a closely wound helical winding of a further material.

11. A string according to claim 10, wherein the further material is a metal wire.

* * * * *